US011223099B1

(12) United States Patent
Allen

(10) Patent No.: US 11,223,099 B1
(45) Date of Patent: Jan. 11, 2022

(54) INTERFACE ASSEMBLY WITH A CTE MATCHED CONSTRAINT LAYER

(71) Applicant: LOCKHEED MARTIN CORPORATION, Bethesda, MD (US)

(72) Inventor: Bradley Frank Allen, Denver, CO (US)

(73) Assignee: Lockhead Martin Corporation, Bethesda, MD (US)

( * ) Notice: Subject to any disclaimer, the term of this patent is extended or adjusted under 35 U.S.C. 154(b) by 0 days.

(21) Appl. No.: 16/789,336

(22) Filed: Feb. 12, 2020

(51) Int. Cl.

| | |
|---|---|
| ***H01P 5/08*** | (2006.01) |
| ***H01P 3/08*** | (2006.01) |
| ***H01P 3/12*** | (2006.01) |
| ***H01P 11/00*** | (2006.01) |
| ***H01P 5/107*** | (2006.01) |

(52) U.S. Cl.
CPC ..... *H01P 5/08* (2013.01); *H01P 3/081* (2013.01); *H01P 3/121* (2013.01); *H01P 5/107* (2013.01); *H01P 11/002* (2013.01); *H01P 11/003* (2013.01)

(58) Field of Classification Search
CPC .... H01P 5/02; H01P 5/028; H01P 5/08; H01P 5/107
USPC ..... 333/24 R, 246, 26
See application file for complete search history.

(56) References Cited

U.S. PATENT DOCUMENTS

2008/0297283 A1* 12/2008 Byun et al. ..... H01P 5/107 333/21 R
2012/0256707 A1* 10/2012 Leiba et al. ..... H01P 5/107 333/208

OTHER PUBLICATIONS

"A Wideband SIW-to-Waveguide Transition at W-band," Di Zhang et al., IEEE 2017.

* cited by examiner

*Primary Examiner* — Benny T Lee
(74) *Attorney, Agent, or Firm* — Morgan, Lewis & Bockius LLP

(57) ABSTRACT

An interface assembly includes a constraint layer formed from a material that provides a coefficient of thermal expansion match between first and second circuit board substrates. The constraint layer includes a waveguide cavity that extends between first and second opposing outer surface the constraint layer. The first and second circuit board substrates are respectively coupled to the first and second outer surfaces of the constraint layer via single ground connections. Portions of the first and second circuit board substrates are aligned with the waveguide cavity and positive connections are made between components of the first and second circuit boards through the waveguide cavity.

17 Claims, 11 Drawing Sheets

300
| Material | Dielectric (Electrical) | Wavelength (Mechanical Tolerance) | CTE(Thermal) |
|---|---|---|---|
| HTCC | 8.8 | 0.088" | 7.5 ppm/K |
| LCP | 2.9 | 0.153" | 18 ppm/K |
FIG. 3
(PRIOR ART)
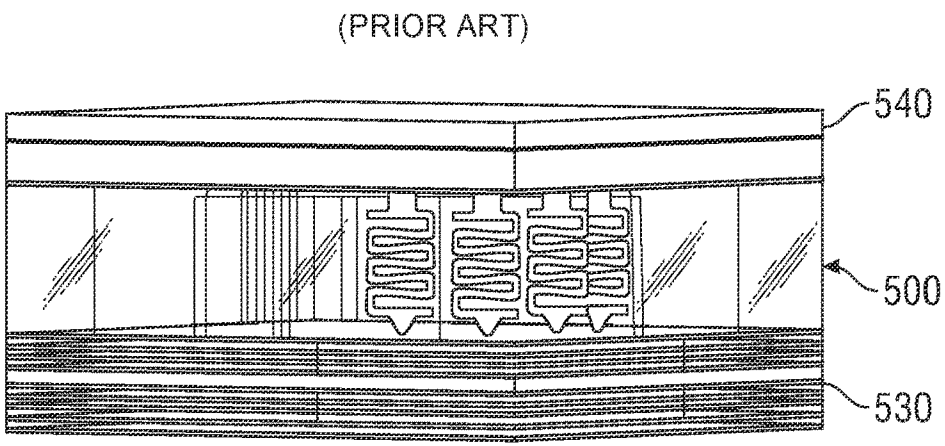
FIG. 5
(PRIOR ART)
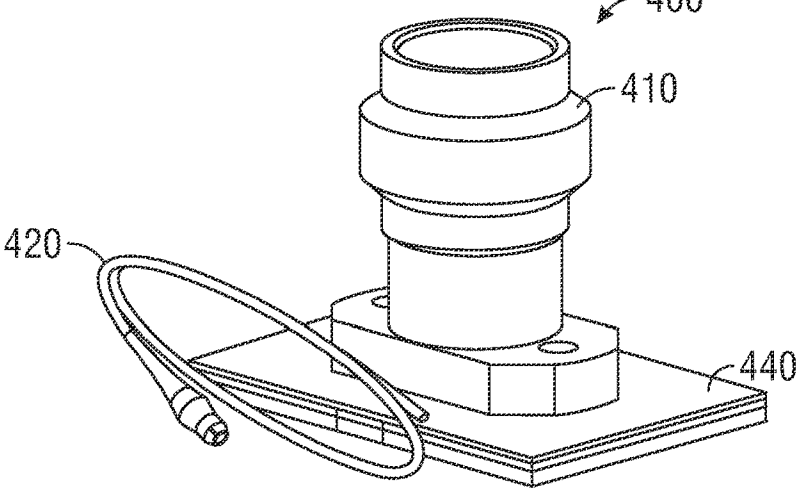
FIG. 4

(PRIOR ART)

1600

| Object Name | Material | Electrical Conductivity [S/m] | Relative Permittivity [$\varepsilon_R$] | Dielectric Loss Tangent |
|---|---|---|---|---|
| Ceramic Layer Metal | Tungsten | 5460000 | N/A | N/A |
| Ceramic Carrier Substrate | High Temperature Co-Fired Ceramic | N/A | 8.7 | 0.003 |
| Waveguide Metal (Constraining Layer) | Copper-Invar-Copper | 1149425 | N/A | N/A |
| Waveguide Fill Material | Air/Vacuum | N/A | 1.0 | 0.0 |
| LCP Layer Metal | Copper | 44500000 | N/A | N/A |
| LCP Substrate | LCP Substrate | N/A | 3.0 | 0.0016 |
| | LCP Bond Layer | N/A | 2.4 | 0.003 |

1610 1620 1630 1640 1650

FIG. 16

INTERFACE ASSEMBLY WITH A CTE MATCHED CONSTRAINT LAYER

STATEMENT REGARDING FEDERALLY SPONSORED RESEARCH OR DEVELOPMENT

Not applicable.

FIELD OF THE INVENTION

The present invention generally relates to circuit board to circuit board interfaces, and more particularly to a liquid crystal polymer (LCP) circuit board to a high temperature co-fired ceramic (HTCC) carrier waveguide type interface.

BACKGROUND

LCP circuit boards and HTCC carriers have very different electrical, mechanical and thermal properties, making conventional interface techniques very challenging. In addition, a high frequency (e.g., 45 GHz) increases the challenge. Typical LCP to HTCC interface solutions have a high level of complexity and to fall short in electrical performance, mechanical tolerance and/or thermal sensitivity. The high level of complexity and performance shortcomings can also lead to manufacturing risks and require extreme preciseness, which can further increase the costs of manufacturing.

SUMMARY OF THE INVENTION

According to various aspects of the subject technology, methods and configuration are disclosed for providing low-cost and compact waveguide cavity constraint interfaces for coefficient of thermal expansion (CTE) matched coupling of multiple boards/substrates.

In one or more aspects, an interface assembly includes a constraint layer comprising a material having a waveguide cavity that extends from a first outer surface to a parallel second outer surface of the constraint layer. The interface assembly also includes a first substrate coupled to the first outer surface of the constraint layer, the first substrate having one or more first components aligned with the waveguide cavity. The interface assembly further includes a second substrate coupled to the second outer surface of the constraint layer, the second substrate having one or more second components aligned with the waveguide cavity. The constraint layer is configured to provide a coefficient of thermal expansion (CTE) match between the first and second substrates.

In one or more aspects, a board to board interface includes a constraint. The constraint includes a material layer configured to provide a coefficient of thermal expansion (CTE) match between first and second circuit boards and an electrical contact between a ground of the first circuit board and a ground of the second circuit board, and a waveguide cavity disposed within the material layer and extending from a first outer surface of the material layer to a parallel second outer surface of the material layer. The waveguide cavity is configured to receive a coupling structure disposed between the first and second circuit boards.

In one or more aspects, a method of manufacturing a waveguide constraint interface assembly includes fabricating a first piece comprising a material layer and one or more waveguide cavities, wherein the material layer is configured to provide a coefficient of thermal expansion (CTE) match between CTE mismatched circuit board substrates. The method also includes coupling a first surface of the first piece to a first circuit board substrate via a first single ground connection and aligning a portion of the first circuit board substrate with a first waveguide cavity. The method further includes coupling a second surface of the first piece to a second circuit board substrate via a second single ground connection, the first and second surfaces being disposed on opposing sides of the first piece and aligning a portion of the second circuit board substrate with the first waveguide cavity. The method also includes providing one or more positive connections between the first and second circuit boards through the first waveguide cavity.

The foregoing has outlined rather broadly the features of the present disclosure so that the following detailed description can be better understood. Additional features and advantages of the disclosure, which form the subject of the claims, will be described hereinafter.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure.

FIG. 3 is a table of values for HTCC and LCP materials.

FIGS. 4-7 are schematic diagrams illustrating example HTCC to LCP interfaces.

FIG. 16 is a table of assumptions for a model of the assembly of FIG. 11, according to certain aspects of the disclosure.

DETAILED DESCRIPTION OF THE INVENTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block-diagram form in order to avoid obscuring the concepts of the subject technology.

Methods and configurations are described for providing a low-cost and compact waveguide constraint interface. The subject technology provides for a high performance, low complexity and low cost waveguide constraint interface solution for coupling circuit boards and/or substrates together, including communications boards at high frequencies (e.g., 45 GHz). The waveguide constraint interface can be readily manufacture to interface between any size board/substrate and to couple any number of boards/substrates together. The subject technology provides for an interface layer formed from a CTE matching material and having waveguide cavities that align with components on corresponding portions of two opposing boards/substrates. It is this positioning and matching that leads to significant complexity reductions as well as manufacturing risk mitigation.

In particular, the subject technology relates to waveguide constraint interfaces for CTE matched coupling of an HTCC carrier with multiple LCP circuit boards. In one or more implementations, a single waveguide constraint interface of the subject technology can be a constraint layer with multiple waveguide cavities where each waveguide cavity is aligned with a different LCP circuit board and a different portion of the HTCC carrier. In one or more implementations, a single waveguide constraint interface of the subject technology can be a constraint layer with a single waveguide cavity aligned with a single LCP circuit board and a particular portion of the HTCC carrier, where each LCP circuit board is coupled to a different waveguide constraint interface.

Existing solutions are typically at a much higher level of complexity (e.g., multipart multi-component assembly) and costs. Also, existing solutions provide more challenging alignment (e.g., mechanical tolerance issues), particularly when multiple inputs/outputs are included in the same assembly and they are not located very close to each other. The disclosed waveguide constraint interface can be made of one piece and/or section at a lower complexity and/or cost than the traditional approaches.

Figure 1:
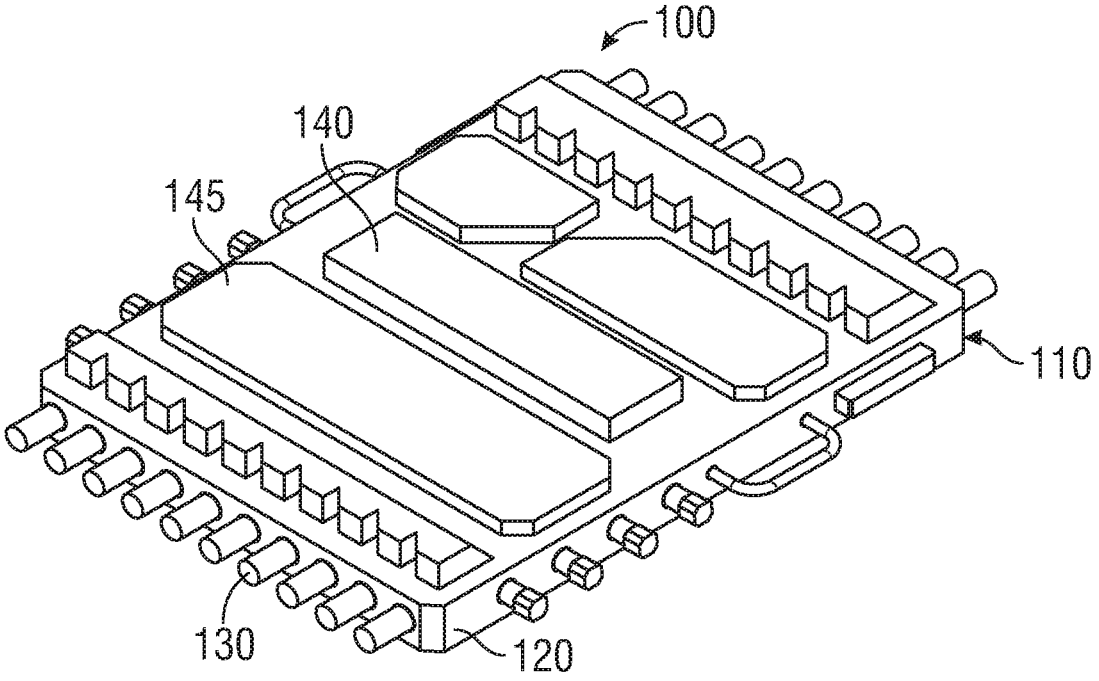
FIG. 1 is a perspective view of an example circuit board assembly.
Figure 2:
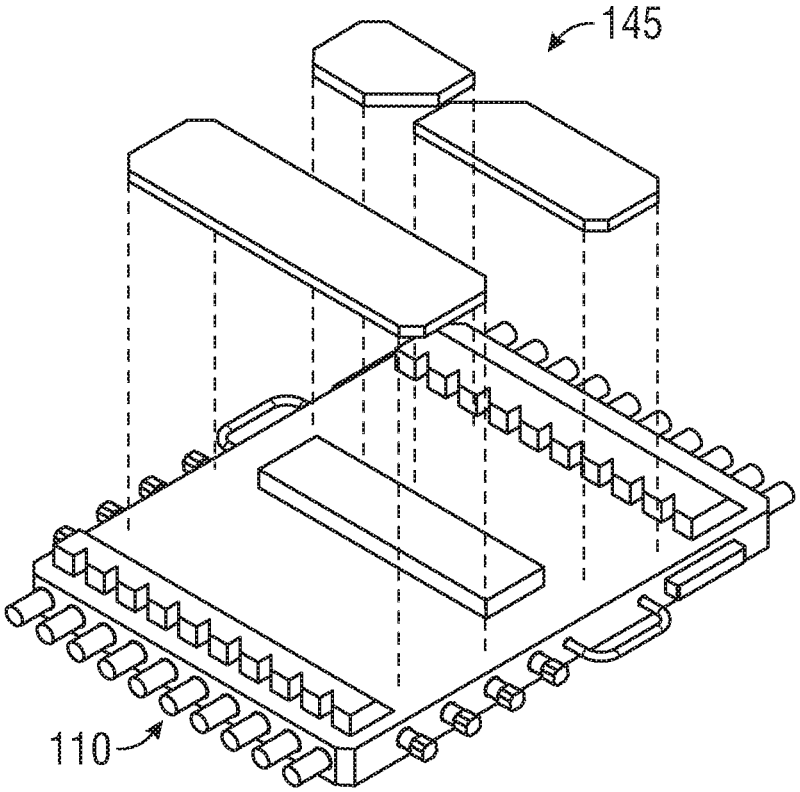
FIG. 2 is an exploded perspective view of the circuit board assembly of FIG. 1.

FIGS. 1 and 2 illustrate a typical circuit board assembly 100, shown here in FIG. 1 as an HTCC carrier and LCP crossover network assembly. The assembly 100 includes an HTCC carrier 110 having a substrate 120 with multiple input/output connectors 130, as shown in FIG. 1. LCP circuit boards 140 (FIG. 1) are disposed on the substrate 120. Some of the LCP circuit boards may be LCP crossover networks 145. Other circuit boards may be transmit/receive (TR) modules or multiple in/multiple out (MIMO) systems, for example.

FIG. 3 is a table 300 illustrating some of the wide differences between HTCC and LCP materials used in the assembly 100. For example, the HTCC material has an electrical dielectric of 8.8 while the LCP material has an electrical dielectric of 2.9. In another example, the HTCC material has a mechanical wavelength tolerence of 0.153" while the LCP material has a mechanical wavelength tolerence of 0.088". In yet another example, the HTCC material has a coefficient of thermal expansion (CTE) of 7.5 ppm/K while the LCP material has a thermal CTE of 18 ppm/K. Interfacing HTCC and LCP materials with such wide ranging electrical, mechanical and thermal properties is difficult and typically requires compromising on some elements.

FIGS. 4-7 are schematic diagrams illustrating typical solutions currently used for interfacing HTCC and LCP materials. As shown in FIG. 4, a cable connector assembly 400 has connectors 410 and cables 420 that can be used to interface an HTCC carrier (not shown) with an LCP circuit board 440. The benefits of the cable and connector solution are that it can be easily tuned for radio frequency (RF) performance, connectors 410 can be easily mounted to both HTCC and LCP boards, and a mechanical frame can thermally isolate the boards. However, the connector 410 and cable 420 solution becomes very expensive and for multiple input/output (I/O) sources. This is particularly true when there are multiple RF/mmW connections. For example, a single LCP board may have four inputs and twelve outputs. Thus, having many LCP boards on a ceramic carrier quickly multiplies the number of inputs and outputs required.

As shown in FIG. 5, an interposer 500 can be disposed between an HTCC carrier 530 and an LCP circuit board 540. A particular interposer 500 provides an interface between specific connections of both HTCC and LCP boards 530, 540. The benefits of the interposer 500 solution are that it can be easily tuned for RF performance and the interposer 500 can be easily embedded into a CTE matching material. However, for high frequencies (e.g., 45 GHz), a very tight pitch is required for the interposer 500, which causes alignment tolerance issues. This is very problematic if the LCP circuit board 540 and HTCC carrier 530 are misaligned due to manufacturing differences between the HTCC and LCP processes. Moreover, it is extremely difficult to obtain or manufacture high performance interposers 500 at mmW frequency ranges.

Figure 6:
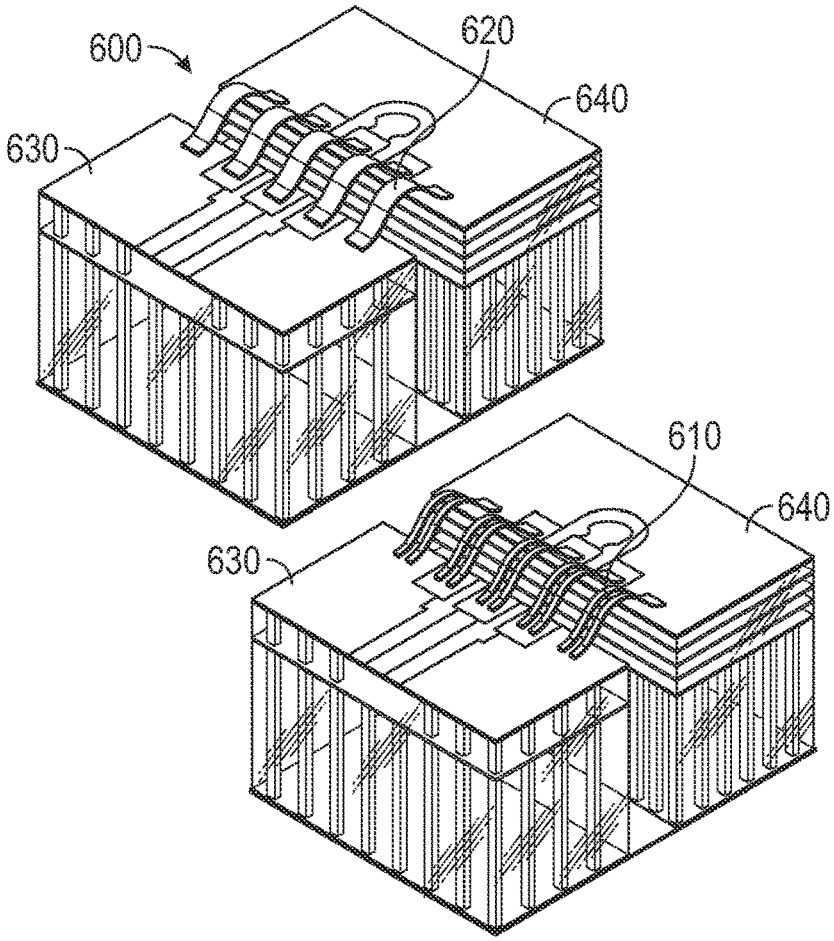
FIG. 6 (PRIOR ART)

FIG. 6 shows a wire bond assembly (e.g., ribbon bond) 600 as yet another example of an interface between an HTCC board 630 and an LCP board 640. Multiple paired wires 610 or ribbon wires 620 are directly attached (e.g., soldered) at both ends to electrical contacts on the HTCC board 630 and the LCP board 640. The benefits of the wire bond assembly 600 solution are that the resulting interface can allow for both thermal and mechanical movement of either or both boards 630, 640. However, a distinct downside is that RF performance of the system will be extremely sensitive to bond tolerance. Thus, wire bond assembly 600 is only useful if RF/mmW interconnects are spaced far enough apart so that interference from adjacent channels do not cause performance issues. If, however, a particular application require the RF/mmW interconnects to be fairly close to one another, the isolation from one interconnect to the next can degrade system performance to the point of not being useable. Moreover, wire bonds can have unpredictable variability that may result in shorted or open circuits if there are any assembly issues.

Figure 7:
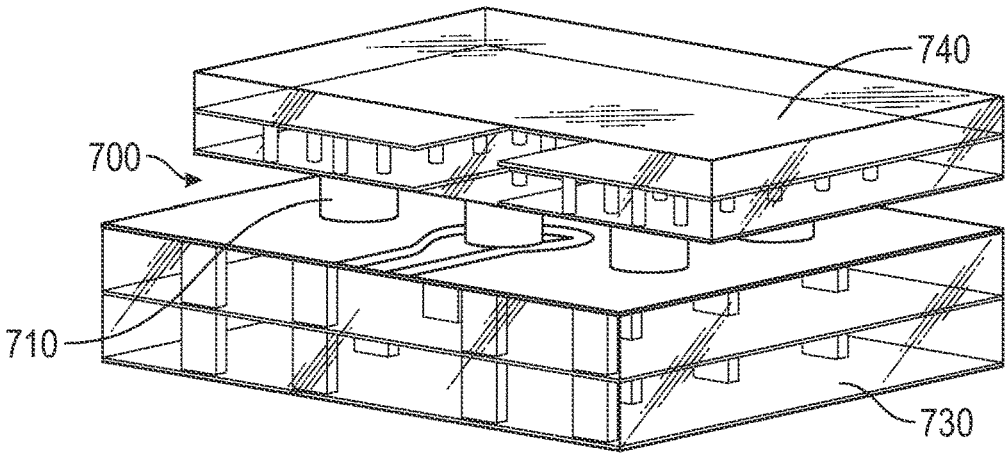

FIG. 7 shows an example of a pillar interface 700 between an HTCC board 730 and an LCP board 740. Here, copper pillars 710 are disposed between and connected to both the HTCC board 730 and the LCP board 740. The benefits of the pillar interface 700 solution are that it can be easily tuned for RF performance and adding the copper pillars 710 is a repeatable process. However, a significant downside is that pillar interface 700 cannot handle thermal stresses caused from a large CTE mismatch of the boards 730, 740. Thus, while copper pillars 710 provide a highly reliable RF/mmW interconnect, they cannot support the large CTE mismatch if the LCP board 740 substrate is somewhat large in size.

Another solution for interfacing HTCC and LCP boards is to make the LCP substrate smaller in size. However, breaking up the LCP substrate into smaller sizes is only a viable solution if the LCP substrate can be subdivided or broken up. In applications that require large LCP substrates, this solution is not useful.

Each of the above-discussed solutions require two isolated conductors, which typically requires very small and fine features. The resulting design can thus be more sensitive to manufacturing tolerances.

Figure 8:
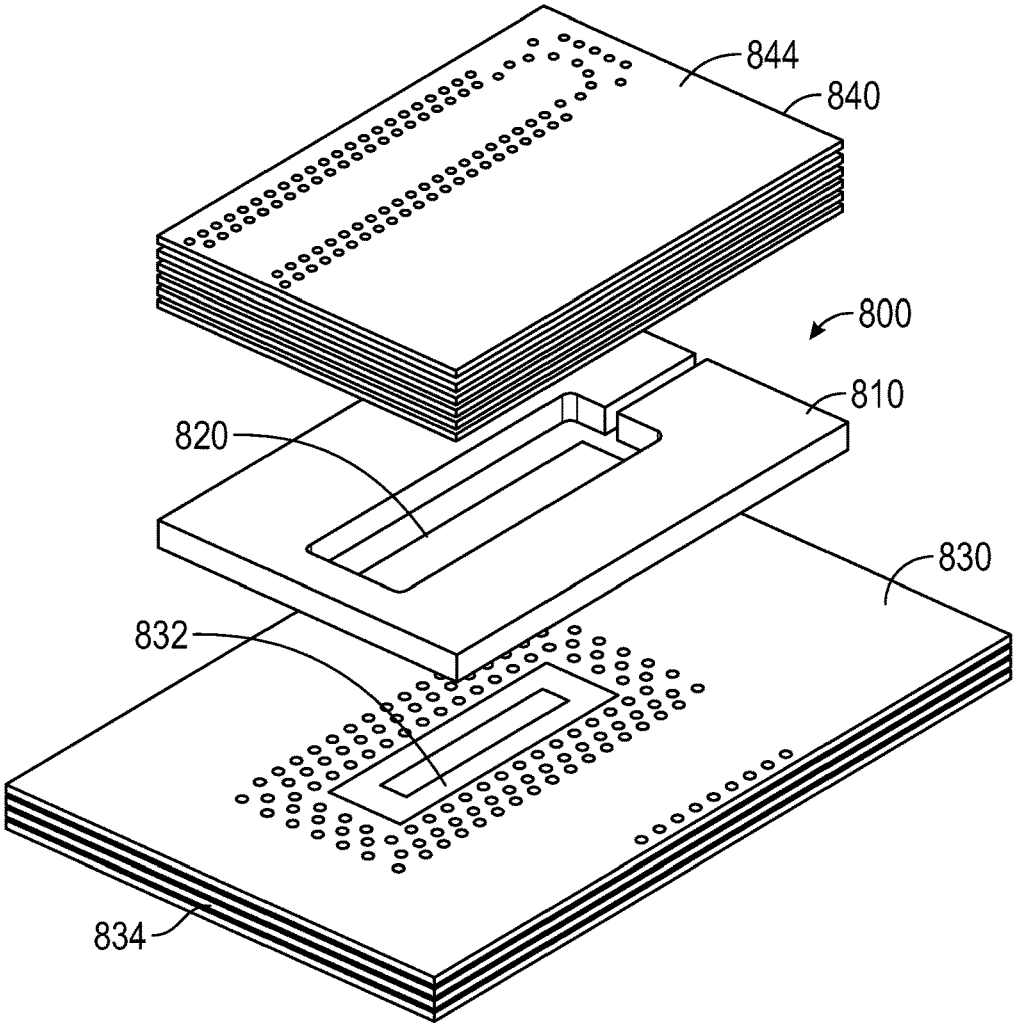
FIG. 8 is an exploded view of an interface assembly, according to certain aspects of the disclosure.
Figure 9:
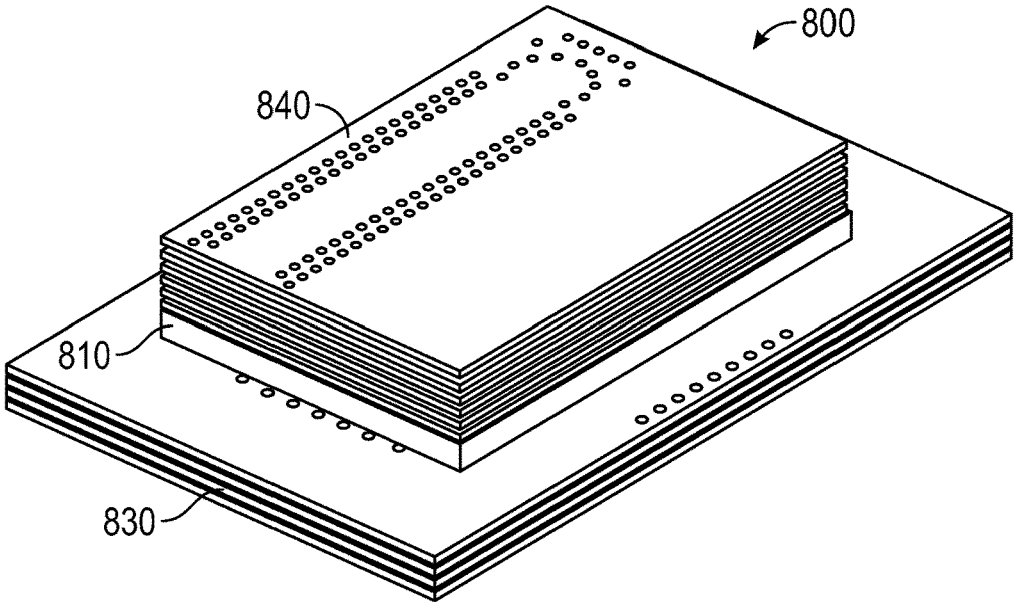
FIG. 9 is a perspective view of the interface assembly of FIG. 8, according to certain aspects of the disclosure.
Figure 10:
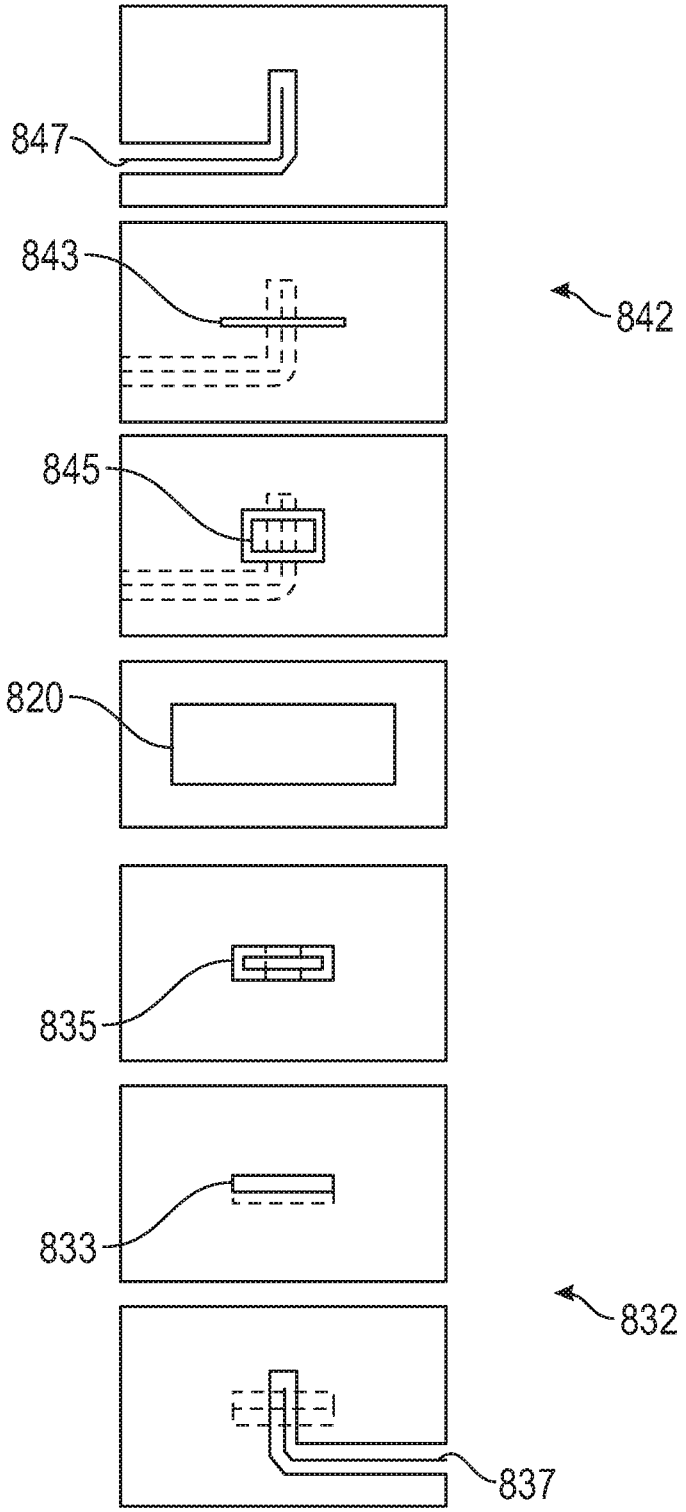
FIG. 10 is a schematic diagram of layers of the interface assembly of FIG. 8, according to certain aspects of the disclosure.

FIGS. 8-10 show an example of an interface assembly 800 (FIG. 8), according to one or more aspects of the subject technology. The interface assembly 800 includes a constraint layer 810 (FIG. 8) disposed between an HTCC carrier 830 (FIG. 8) and an LCP circuit board (e.g., LCP crossover network) 840 (FIG. 8). The HTCC carrier 830 includes a stripline fed slot-coupled patch artwork 832 (FIG. 8) and the LCP circuit board 840 includes a stripline fed slot-coupled patch artwork 842 (FIG. 10). The constraint layer 810 has a waveguide cavity (e.g., cutout) 820 disposed within the constraint layer 810. The constraint layer 810 may be formed of copper tungsten, for example, and configured to CTE match the HTCC carrier 830 and the LCP circuit board 840 to each other. The waveguide cavity 820 may be cut out of the constraint layer 810 to provide for a coupling structure. A large physical size of the waveguide cavity 820 provides for a significant alignment tolerance margin. In other words, the waveguide cavity 820 allows for a wide range of misalignments between the HTCC carrier 830 and the LCP circuit board 840 during the manufacturing process.

The interface assembly 800 (FIG. 8) provides an RF/mmW waveguide type connection between the HTCC carrier 830 (FIG. 8) and the LCP circuit board 840 (FIG. 8). The waveguide cavity 820 (FIG. 8) provides waveguide like elements, such as not requiring two isolated conductors to make a reliable connection. Thus, no two plus terminal interconnect is necessary with the interface assembly 800 (FIG. 8). In other words, only a single ground connection is needed, as no positive connection with any interconnect is required. The waveguide cavity 820 is much smaller than a wavelength, which makes it short electrically with respect to the wavelength.

Further, the fundamental waveguide mode (e.g., TE10) is excited in the waveguide, thought the TE10 mode does not propagate over any significant distance with respect to a wavelength. The excitation of the waveguide mode is provided by the HTCC stripline fed slot-coupled patch artwork 832 (FIG. 8) and the LCP stripline fed slot-coupled patch artwork 842. For example, as shown in FIG. 10, a slot 833 (FIG. 10) is disposed in an HTCC substrate 834 (FIG. 8) beneath a patch 835 and a stripline (e.g., trace) 837 (FIG. 10) is disposed in the HTCC substrate 834 beneath the slot 833. Similarly, a slot 843 (FIG. 10) is disposed in an LCP substrate 844 (FIG. 8) beneath a patch 845 (FIG. 10) and a stripline 847 (FIG. 10) is disposed in the LCP substrate 844 (FIG. 8) beneath the slot 843 (FIG. 10). Thus, the HTCC patch 835 and the LCP patch 845 are excited by their respective striplines 837 (FIG. 10), 847 (FIG. 10). \

The waveguide cavity 820 is formed directly (e.g., machined) within the constraint layer 810 of the interface assembly 800. This eliminates the need for additional manufacturing process steps in the mounting of the LCP substrate 844 (FIG. 8) onto the HTCC substrate 834. Thus, the interface assembly 800 is a waveguide like solution that provides a high performing RF/mmW connection embedded solely in the constraint layer 810, where the constraint layer 810 controls for any CTE mismatch between the HTCC carrier 830 and the LCP circuit board 840. Accordingly, no additional components are required to be added to either the HTCC substrate 834 or the LCP substrate 844 (FIG. 8), which is very beneficial as both the HTCC carrier 830 and the LCP circuit board 840 are already multi-layer modules. Further, the waveguide cavity 820 has much larger dimensions than a center pin of an RF coaxial connector, for example. Thus, the interface assembly 800 is less sensitive to manufacturing tolerances than the RF coaxial connector.

The interface assembly 800 has no limitation in the size of the HTCC carrier 830 and the LCP circuit board 840. For example, as shown in FIGS. 8 and 9, the interface assembly 800 may be sized and shaped to match the footprint of the LCP substrate 844 (FIG. 8) on the HTCC substrate 834 (FIG. 8), no matter how large or small the LCP substrate 844. Thus, multiple different sized LCP circuit boards 840 (FIG. 8) may be coupled to or mounted on a larger sized HTCC substrate 834, where each LCP circuit board 840 has a size matched interface assembly 800 disposed between the LCP circuit board 840 and the HTCC substrate 834. In some embodiments, as shown in FIG. 8, the HTCC substrate 834 has a larger surface area than the LCP substrate 844. For example, the assembly 100 shown in FIG. 1 could be designed so that each LCP circuit board 140/LCP crossover network 145 is disposed on a matching sized and shaped interface assembly 800, which in turn is disposed on the substrate 120.

In one or more aspects, the constraint layer 810 may be sized and shaped differently than the LCP circuit board 840. For example, the constraint layer 810 may be sized and shaped to match the HTCC carrier 830, with a corresponding waveguide cavity 820 (FIG. 8) for each LCP circuit board 840 disposed on the constraint layer 810. As another example, the assembly 100 shown in FIG. 1 could be designed so that each LCP circuit board 140/LCP crossover network 145 is disposed on a single interface assembly 800, which in turn is disposed on the substrate 120 and is sized and shaped to match the size and shape of the substrate 120. Here, the single interface assembly 800 would have many waveguide cavities 820, with a waveguide cavity 820 disposed under each LCP circuit board 140/LCP crossover network 145.

Thus, there can be as many waveguide cavities 820 in a single constraint layer 810 as desired, with the resulting benefit that the constraint layer 810 is less sensitive to tolerance issues because its size is much larger than other interface solutions. Accordingly, there is no limitation in the size of the HTCC and/or LCP substrates, or in the number of interconnects, for an assembly. Any desired positive connections between boards may be provided by coupling through the constraint layer 810. For example, a resonator in an LCP circuit board 840 may be coupled to a resonator in a ceramic carrier 830 through the constraint layer 810 for an RF signal.

The interface assembly 800 is not a two terminal connection and is also not a typical waveguide transition to/from multiple boards. The interface assembly 800 is a coupled resonator type of structure that acts as a direct current (DC) block and yields a bandpass filter response. In addition, the interface assembly 800 is a strong mechanical and thermal interface between the HTCC carrier 830 and the LCP circuit board 840, and is location insensitive. Accordingly, the interface assembly 800 requires minimal assembly and is low cost (e.g., simple and inexpensive to manufacture).

Figure 11:
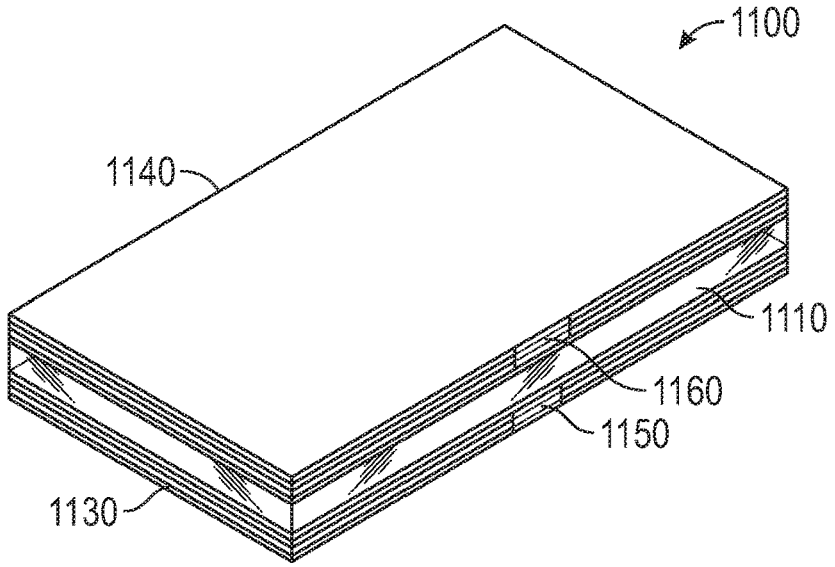
FIG. 11 is a perspective view of an electronic assembly, according to certain aspects of the disclosure.
Figure 12:
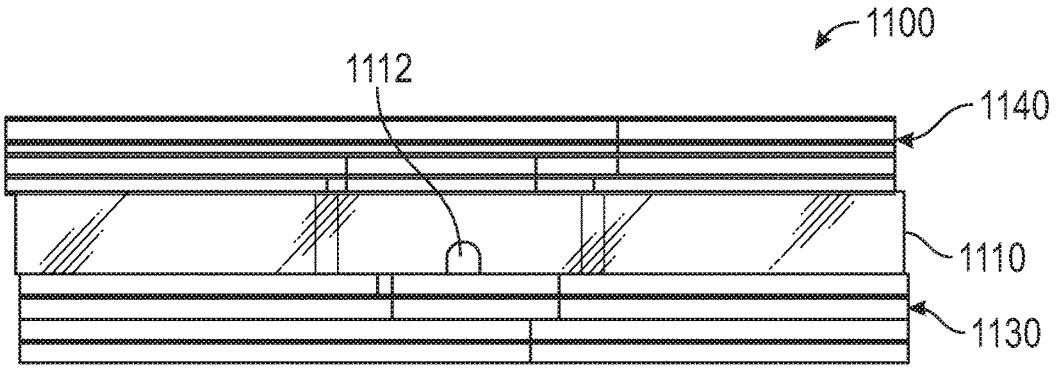
FIGS. 12 and 13 are side views of the assembly of FIG. 11, according to certain aspects of the disclosure.
Figure 13:
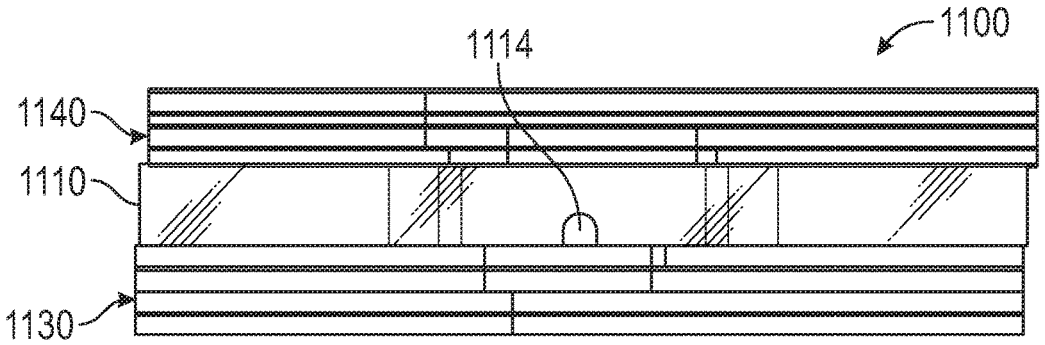

FIG. 11 is a perspective view of an electronic assembly 1100 having a ceramic carrier 1130 also shown in FIGS. 12-15), an LCP board 1140 also shown in FIGS. 12 and 13) and a waveguide constraint interface 1110. The ceramic carrier 1130 has a first port 1150 and the LCP board 1140 has a second port 1160. The waveguide constraint interface 1110 has vent holes 1112, 1114 for outgassing as shown respectively in FIGS. 12 and 13. For example, vent holes 1112, 1114 may be used for space applications where it is desired to not have trapped gasses when the payload is released into the vacuum of space. The waveguide constraint interface 1110 may be configured such that there is little or no difference in performance with or without vent holes.

Figure 14:
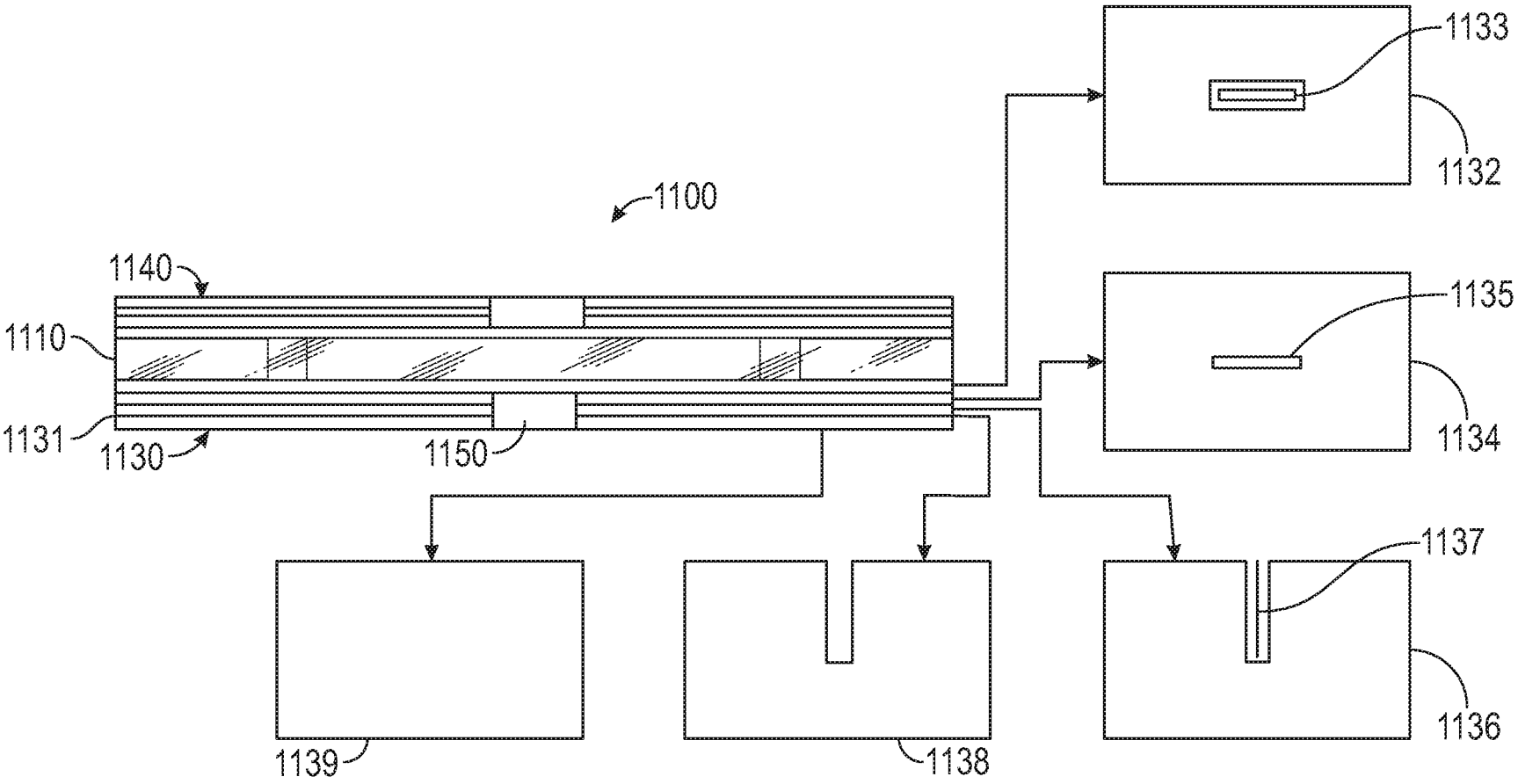
FIG. 14 is a front view of the assembly of FIG. 11 with schematic diagrams of multiple layers of a ceramic carrier, according to certain aspects of the disclosure.

The ceramic carrier 1130 has a multi-layer substrate 1131 as shown in FIG. 14. A top surface layer 1132 (e.g., surface coupled to the constraint interface 1110) is a first ground layer with a microstrip type patch 1133. A second layer 1134 is also a ground layer with a slot 1135 that is aligned with (e.g., disposed directly underneath) the microstrip type patch 1133. A third ground layer 1136 has an RF stripline 1137 aligned with (e.g., disposed directly underneath) the slot 1135 and also with the microstrip type patch 1133. A fourth ground layer 1138 is followed by a bottom surface layer 1139 that is a fifth ground layer, the bottom surface layer 1139 being the bottom surface of the ceramic carrier 1130. The first port 1150 is disposed across the second through fourth layers 1134, 1136, 1138.

Figure 15:
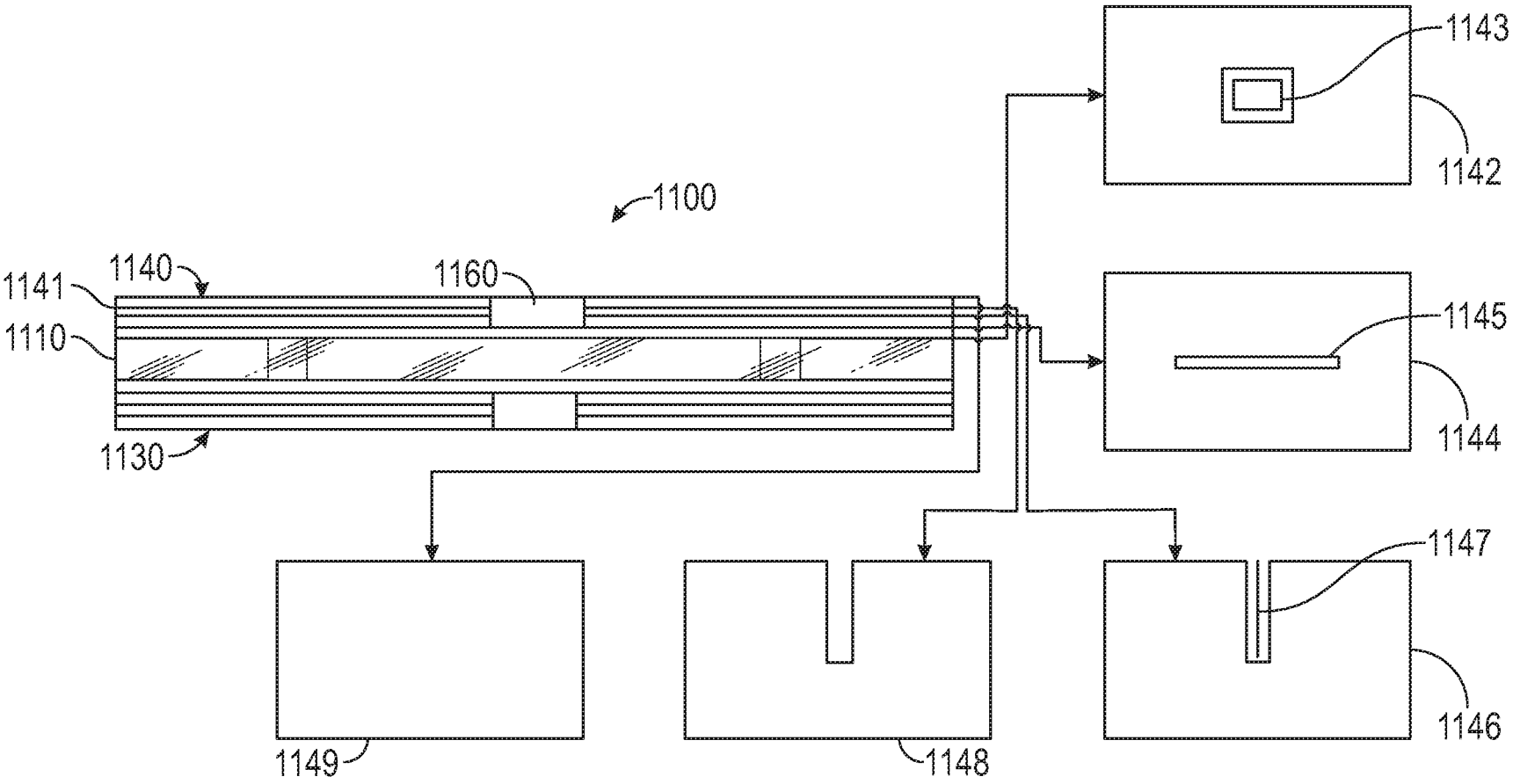
FIG. 15 is a front view of the assembly of FIG. 11 with schematic diagrams of multiple layers of an LCP substrate, according to certain aspects of the disclosure.

The LCP board 1140 has a multi-layer substrate 1141 as shown in FIG. 15. A bottom surface layer 1142 (e.g., surface coupled to the constraint interface 1110) is a first ground layer with a microstrip type patch 1143. A second layer 1144 is also a ground layer with a slot 1145 that is aligned with (e.g., disposed directly above) the microstrip type patch 1143. A third ground layer 1146 has an RF stripline 1147 aligned with (e.g., disposed directly above) the slot 1145 and also with the microstrip type patch 1143. A fourth ground layer 1148 is followed by a top surface layer 1149 that is a fifth ground layer, the top surface layer 1149 being the top surface of the LCP board 1140. The second port 1160 is disposed across the second through fourth layers 1144, 1146, 1148.

As shown in FIG. 16, table 1600 shows assumed values for various model elements of the assembly 1100 shown in FIGS. 11-14. A list of objects 1610 (e.g., components of assembly 1100, ceramic layer metal, ceramic carrier substrate, waveguide metal (constraining layer), waveguide fill material, LCP layer material, and LCP substrate) and the corresponding material 1620 of each object (tungsten, high temperature co-fired ceramic, copper-invar-copper, air/vacuum, copper, LCP substrate, LCP bonding layer, respectively) are shown in the first two columns. The third through fifth columns list the corresponding electrical conductivity value 1630 (5,460,000 S/m, N/A, 1,149,425 S/m, N/A, 44,500,000 S/m, N/A, N/A, respectively), relative permittivity $\varepsilon_R$ value 1640 (N/A, 8.7, N/A, 1.0, N/A, 3.0, and 2.4, respectively) and dielectric loss tangent value 1650 (N/A, 0.003, N/A, 0.0, N/A, 0.0016, and 0.003, respectively).

FIGS. 12 and 13 are side views of the assembly 1100 of FIG. 11, according to certain aspects of the disclosure.

FIG. 14 is a front view of the assembly 1100 of FIG. 11 with schematic diagrams of multiple layers of a ceramic carrier, according to certain aspects of the disclosure.

FIG. 15 is a front view of the assembly of 1100 FIG. 11 with schematic diagrams of multiple layers of an LCP substrate, according to certain aspects of the disclosure.

FIG. 16 is a table 1600 of assumptions for a model of the assembly 1100 of FIG. 11, which includes columns 1610, 1620, 1630, 1640 and 1650, according to certain aspects of the disclosure.

Figure 17:
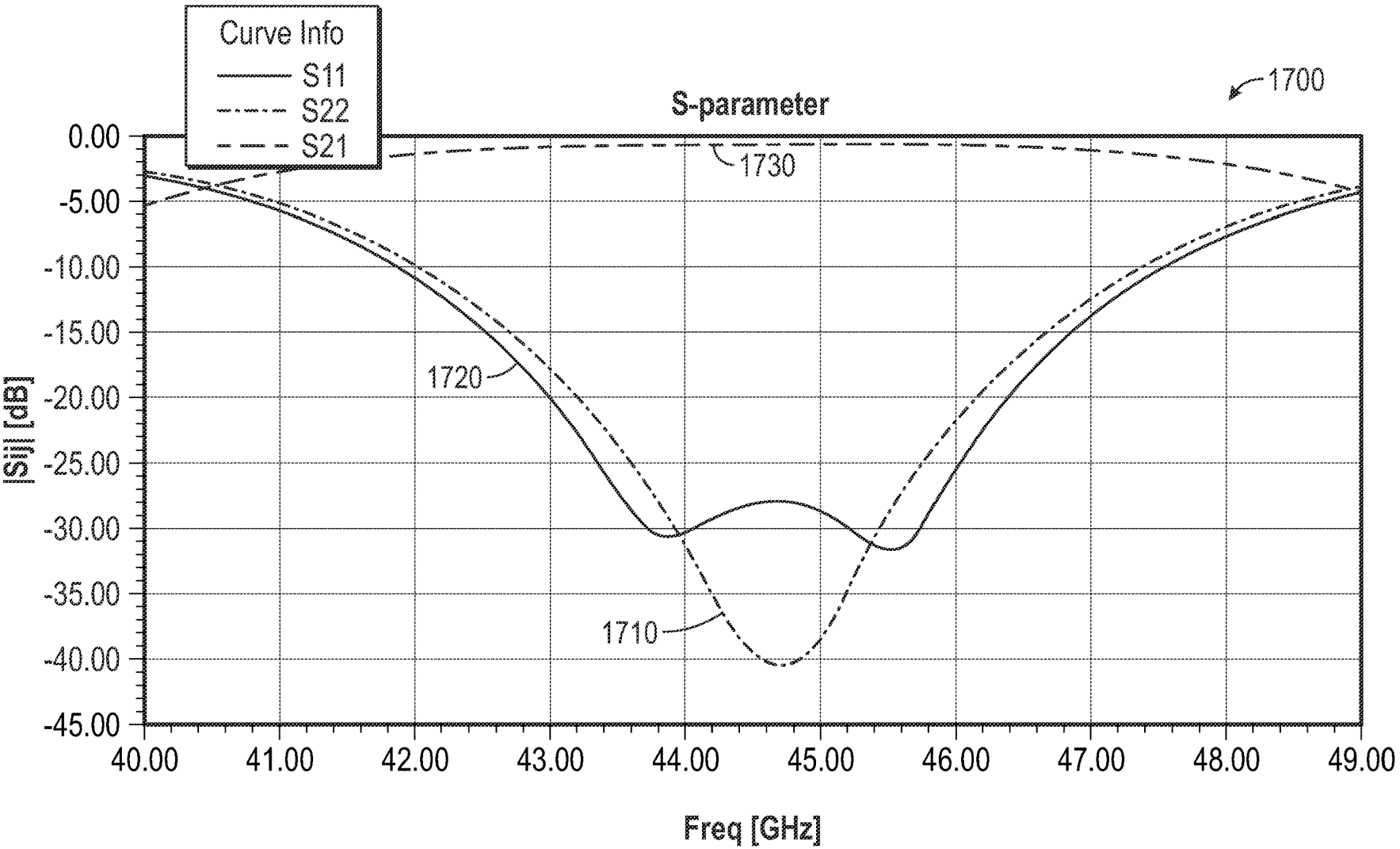
FIG. 17 is a graphic diagram illustrating results of the model of the assembly of FIG. 11, according to certain aspects of the disclosure.

FIG. 17 is chart 1700 showing plots 1710, 1720 and 1730 of the variation of S-parameters (Sij [dB]) over a frequency range of 40-49 GHz for the model of assembly 1100. The S-parameters values, as depicted by plot 1710 (dashed-dotted line, S22), are between about −18 dB to −41 dB within a defined frequency range of 43.20-46.30 GHz, with an S-parameter value of −19.86 dB at 43.20 GHZ and an S-parameter value of −18.28 dB at 46.30 GHz. Similarly, the S-parameters values, as depicted by plot 1720 (solid line, S11), are between about −20 dB to −32 dB within the defined frequency range, with an S-parameter value of −22.62 dB at 43.20 GHZ and an S-parameter value of −20.96 dB at 46.30 GHz. Plot 1730 (dashed line, S21) shows S-parameters values within the defined frequency range between −0.76 dB at 43.20 GHZ and −0.78 dB at 46.30 GHz.

The subject technology (e.g., constraint layer 810, waveguide constraint interface 1110) is not limited to interfacing ceramic and LCP substrates. For example, in some aspects the subject technology may be an interface between a soft organic board (e.g., FR4) and an LCP substrate, or between an FR4 board and a ceramic carrier. Accordingly, the subject technology may interface any board to any other board, including any multi-layer board to any other multi-layer board. For example, the subject technology may interface circuit boards of the same or different material, such as LCP to LCP, standard PCB to PCB, Ceramic to Ceramic, or any combination.

Figure 18:
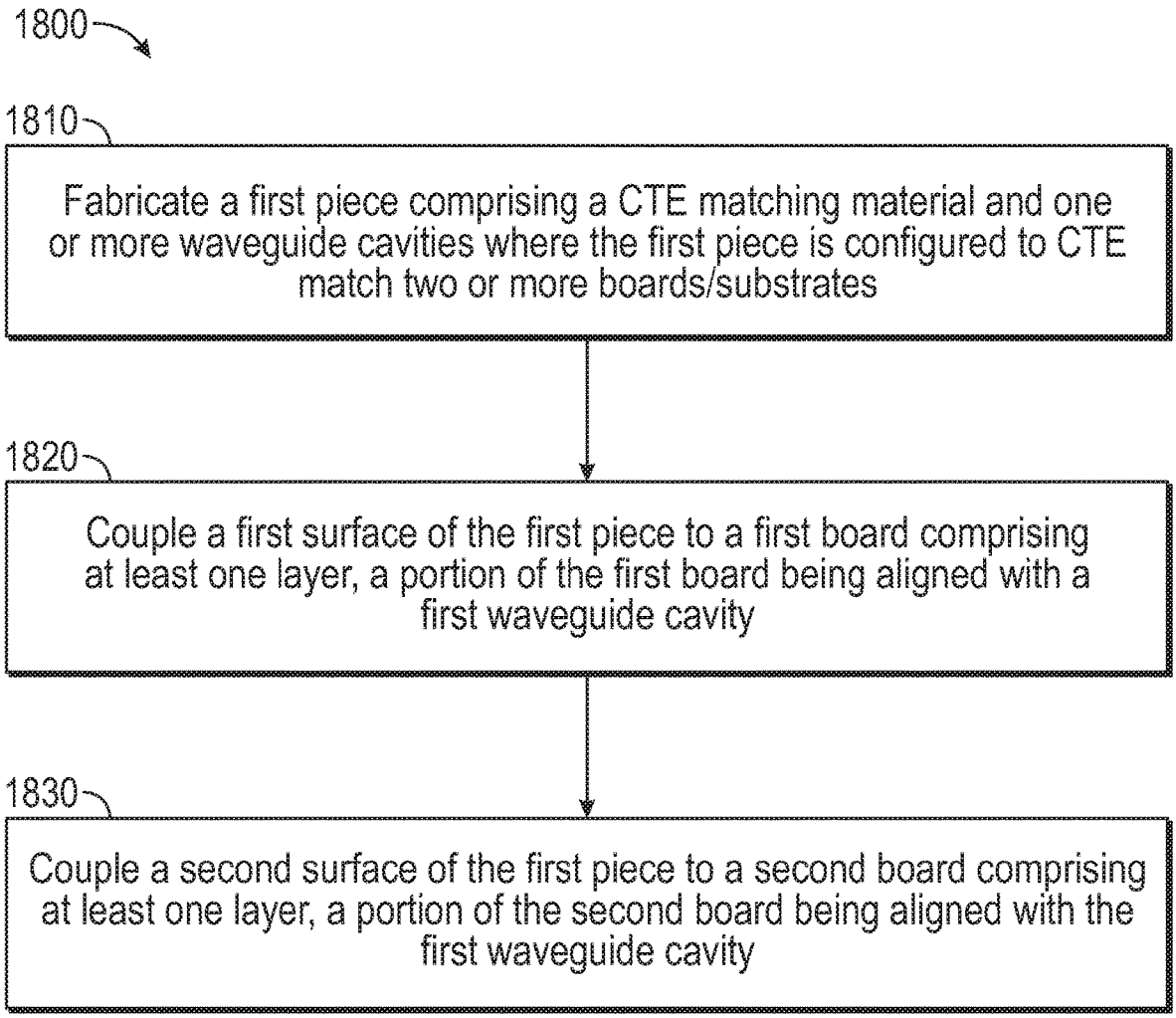
FIG. 18 illustrates a flow diagram of an example process for manufacturing an assembly with an HTCC to LCP interface, according to certain aspects of the disclosure.

FIG. 18 illustrates a flow diagram of an example process 1800 for manufacturing a waveguide constraint interface assembly, according to certain aspects of the disclosure. For explanatory purposes, the process 1800 is primarily described herein with reference to the interface assembly 800, or the electronic assembly 1100, and various components described herein with reference to FIGS. 8-15.

The process 1800 includes fabricating a first piece (e.g., constraint layer 810 of FIGS. 8-10; waveguide constraint interface 1110) comprising a CTE matching material (e.g., copper tungsten) and one or more waveguide cavities (e.g., waveguide cavity 820 of FIGS. 8-10), where the first piece is configured to CTE match two or more boards/substrates (e.g., HTCC carrier 830 and LCP circuit board 840 of FIGS. 8-10) (1810).

The method further includes coupling a first surface of the first piece to a first board (e.g., ceramic carrier 1130 of FIGS. 11-15) comprising at least one layer (e.g., multi-layer substrate 1131 of FIG. 14), a portion of the first board being aligned with a first waveguide cavity (e.g., waveguide cavity 820 of FIGS. 8-10) (1820).

The method further includes coupling a second surface of the first piece to a second board (e.g., LCP circuit board 1140 of FIGS. 11-15) comprising at least one layer (e.g., multi-layer substrate 1141 of FIG. 15), a portion of the second board being aligned with the first waveguide cavity (e.g., waveguide cavity 820 of FIGS. 8-10), where one or more positive connections between the first and second boards may be provided through the first waveguide cavity (1830).

In some aspects, the subject technology is related to communications technology, and more particularly to an array module and LCP crossover networks. In some aspects, the subject technology may be used in various markets, including, for example and without limitation, sensor technology, communication systems and radar technology markets.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionalities. Whether such functionalities are implemented as hardware or software depends upon the particular application and design constraints imposed on the overall system. Skilled artisans may implement the described functionalities in varying ways for each particular application. Various components and blocks may be arranged differently (e.g., arranged in a different order, or partitioned in a different way), all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks may be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single hardware and software product or packaged into multiple hardware and software products.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meanings unless otherwise explicitly and clearly defined by the patentee. If there is any conflict in the usage of a word or term in this specification and one or more patent or other documents that may be incorporated herein by reference, the definition that is consistent with this specification should be adopted.

What is claimed is:

1. A method of manufacturing a waveguide constraint interface assembly, the method comprising:

fabricating a first piece comprising a material layer and one or more waveguide cavities, wherein the material layer is configured to provide a coefficient of thermal expansion (CTE) match between CTE mismatched circuit board substrates;

coupling a first surface of the first piece to a first one of the circuit board substrates via a first single ground connection;

aligning a portion of the first one of the circuit board substrates with a first waveguide cavity of the one or more waveguide cavities;

coupling a second surface of the first piece to a second one of the circuit board substrates via a second single ground connection, the first and second surfaces being disposed on opposing sides of the first piece;

aligning a portion of the second one of the circuit board substrates with the first waveguide cavity; and providing one or more positive connections between the first and second ones of the circuit board substrates through the first waveguide cavity.

2. An interface assembly comprising:

a constraint layer comprising a material having at least one waveguide cavity that extends from a first outer surface to a parallel second outer surface of the constraint layer;

a first substrate coupled to the first outer surface of the constraint layer, the first substrate having one or more first components aligned with the at least one waveguide cavity; and at least one second substrate coupled to the second outer surface of the constraint layer, the at least one second substrate having one or more second components aligned with the at least one waveguide cavity, wherein the constraint layer is configured to provide a coefficient of thermal expansion (CTE) match between the first and second substrates, and wherein the first substrate has a larger surface area than the second substrate.

3. The interface assembly of claim 2, wherein the at least one waveguide cavity constraint layer comprises a plurality of waveguide cavities.

4. The interface assembly of claim 3, further comprising wherein the at least one second substrate comprises a plurality of layers coupled to the second outer surface of the constraint layer, wherein each layer is aligned with a different one of the plurality of waveguide cavities.

5. The interface assembly of claim 2, wherein the constraint layer comprises a vent hole disposed on a third surface of the constraint layer, the third surface being orthogonal to the first and second outer surfaces of the constraint layer.

6. The interface assembly of claim 2, wherein the first substrate comprises a high temperature co-fired ceramic carrier and the at least one second substrate comprises a liquid crystal polymer circuit board.

7. The interface assembly of claim 6, wherein the constraint layer comprises a copper tungsten material configured to provide the CTE match between the high temperature co-fired ceramic carrier and the liquid crystal polymer circuit board.

8. The interface assembly of claim 2, wherein the first substrate is a multi-layer board comprising:

a first layer adjacent to the first outer surface of the constraint layer, the first layer having a microstrip patch;

a second layer adjacent to the first layer, the second layer having a slot; and a third layer adjacent to the second layer, the third layer having a radio frequency stripline, wherein the microstrip patch, the slot and the radio frequency stripline are aligned, and the radio frequency stripline is configured to excite the microstrip patch.

9. The interface assembly of claim 8, wherein the multi-layer board further comprises:

a fourth layer adjacent to the third layer;

a fifth layer adjacent to the fourth layer; and a port disposed across a plurality of the first to fifth layers.

10. The interface assembly of claim 8, wherein the microstrip patch, the slot and the radio frequency stripline are aligned, and the radio frequency stripline is configured to excite the microstrip patch.

11. The interface assembly of claim 2, wherein the at least one second substrate is a multi-layer board comprising:

a first layer adjacent to the second outer surface of the constraint layer, the first layer having a microstrip patch;

a second layer adjacent to the first layer, the second layer having a slot; and a third layer adjacent to the second layer, the third layer having a radio frequency stripline, wherein the microstrip patch, the slot and the radio frequency stripline are aligned, and the radio frequency stripline is configured to excite the microstrip patch.

12. The interface assembly of claim 11, wherein the multi-layer board further comprises:

a fourth layer adjacent to the third layer;

a fifth layer adjacent to the fourth layer; and a port disposed across a plurality of the first to fifth layers.

13. The interface assembly of claim 2, wherein the at least one waveguide cavity is configured to receive a coupling structure disposed between the first and second substrates.

14. The interface assembly of claim 2, wherein the first and second substrates comprise communications components configured to operate at 45 GHz.

15. The interface assembly of claim 2, wherein the first and second substrates are each connected to the constraint layer by a single ground connection.

16. A board to board interface comprising:

a constraint comprising:

a material layer configured to provide:

a coefficient of thermal expansion (CTE) match between first and second circuit boards; and an electrical contact between a ground of the first circuit board and a ground of the second circuit board;

at least one waveguide cavity disposed within the material layer and extending from a first outer surface of the material layer to a parallel second outer surface of the material layer, wherein the at least one waveguide cavity is disposed between the first and second circuit boards; and a vent hole extending from the at least one waveguide cavity to a third outer surface of the material layer.

17. The board to board interface of claim 16, wherein the at least one waveguide cavity is sized and shaped to align with stripline fed slot-coupled patch artwork on the first and second boards, and wherein a fundamental waveguide mode is configured to be excited in the waveguide cavity.

* * * * *